US009698519B2

(12) United States Patent
Oi et al.

(10) Patent No.: US 9,698,519 B2
(45) Date of Patent: Jul. 4, 2017

(54) WATER-PROOF CONNECTOR FOR AN ELECTRONIC DEVICE

(71) Applicant: KYOCERA CORPORATION, Kyoto (JP)

(72) Inventors: Atsuki Oi, Higashihiroshima (JP); Daisuke Takahashi, Oumihachiman (JP)

(73) Assignee: KYOCERA CORPORATION, Kyoto (JP)

( * ) Notice: Subject to any disclaimer, the term of this patent is extended or adjusted under 35 U.S.C. 154(b) by 0 days.

(21) Appl. No.: 15/266,998

(22) Filed: Sep. 15, 2016

(65) Prior Publication Data

US 2017/0005433 A1 Jan. 5, 2017

Related U.S. Application Data

(63) Continuation of application No. 15/257,764, filed on Sep. 6, 2016, now abandoned, which is a continuation of application No. PCT/JP2015/084322, filed on Dec. 7, 2015.

(30) Foreign Application Priority Data

Dec. 25, 2014 (JP) ..... 2014-262691

(51) Int. Cl.

| | |
|---|---|
| ***H01R 13/52*** | (2006.01) |
| ***H01R 13/73*** | (2006.01) |
| *H01R 13/74* | (2006.01) |
| *H01R 24/58* | (2011.01) |

(52) U.S. Cl.

CPC ..... *H01R 13/5219* (2013.01); *H01R 13/73* (2013.01); *H01R 13/74* (2013.01); *H01R 24/58* (2013.01)

(58) Field of Classification Search

CPC .... H01R 13/5219; H01R 13/73; H01R 24/58; H01R 13/74; H01R 13/52

USPC ..... 439/271

See application file for complete search history.

(56) References Cited

U.S. PATENT DOCUMENTS 8,678,863 B2 * 3/2014 Nagata ..... H01R 13/5213 439/606

2013/0065445 A1 3/2013 Nagata

FOREIGN PATENT DOCUMENTS

JP 2012-059479 A 3/2012

JP 2013-062194 A 4/2013

OTHER PUBLICATIONS

Machine Translation of JP 2012 059 479.*

(Continued)

*Primary Examiner* — Javaid Nasri

(74) *Attorney, Agent, or Firm* — Duane Morris LLP

(57) ABSTRACT

An electronic device includes a housing including an outer surface and an inner surface, the housing including an opening through which the outer surface and the inner surface communicate with each other. The external connection terminal also includes a female connector including a receiver configured to receive at least a part of a male connector inserted externally, the female connector including a conducting portion located to face the inner surface of the housing and electrically connectable to the male connector through the opening, and a seal located around the opening and located obliquely with respect to a direction in which the male connector is received.

4 Claims, 8 Drawing Sheets

(56) References Cited

OTHER PUBLICATIONS

Office Action issued in Basic Japanese Application No. 2014-262691, dated Aug. 5, 2016, and Concise Explanation Thereof, in 5 pages.
Written Opinion of the International Searching Authority in International Application No. PCT/JP2015/084322, dated Feb. 2, 2016, and Concise Explanation Thereof in 10 pages.
International Search Report issued in International Application No. PCT/JP2015/084322, dated Feb. 2, 2016, in 2 pages.

* cited by examiner

WATER-PROOF CONNECTOR FOR AN ELECTRONIC DEVICE

CROSS-REFERENCE TO RELATED APPLICATION

The present application is a continuation application of U.S. patent application Ser. No. 15/257,764, filed on Sep. 6, 2016, which is a continuation application based on PCT Application No. PCT/JP2015/084322 filed on Dec. 7, 2015, which claims the benefit of Japanese Application No. 2014-262691, filed on Dec. 25, 2014. PCT Application No. PCT/JP2015/084322 is entitled "External Connection Terminal Unit and Electronic Device Provided with Same", and Japanese Application No. 2014-262691 is entitled "External Connection Terminal and Electronic Device Including the Same," the contents of which are incorporated by reference herein in their entireties.

FIELD

Embodiments of the present disclosure relate to an electronic device.

BACKGROUND

Waterproofness may be demanded from electronic devices, such as mobile terminals, while including terminals for external connection, such as an earphone connection terminal and a USB terminal.

SUMMARY

An electronic device based on the present disclosure includes a housing including an outer surface and an inner surface. The housing also includes an opening through which the outer surface and the inner surface communicate with each other. The electronic device also includes a female connector including a receiver configured to receive at least a part of a male connector inserted externally, the female connector including a conducting portion located to face the inner surface of the housing and electrically connectable to the male connector through the opening, and a seal located around the opening and located obliquely with respect to a direction in which the male connector is received.

The foregoing and other objects, features, aspects and advantages of the present disclosure will become more apparent from the following detailed description of the present disclosure when taken in conjunction with the accompanying drawings.

DETAILED DESCRIPTION

First Embodiment

Figure 1:
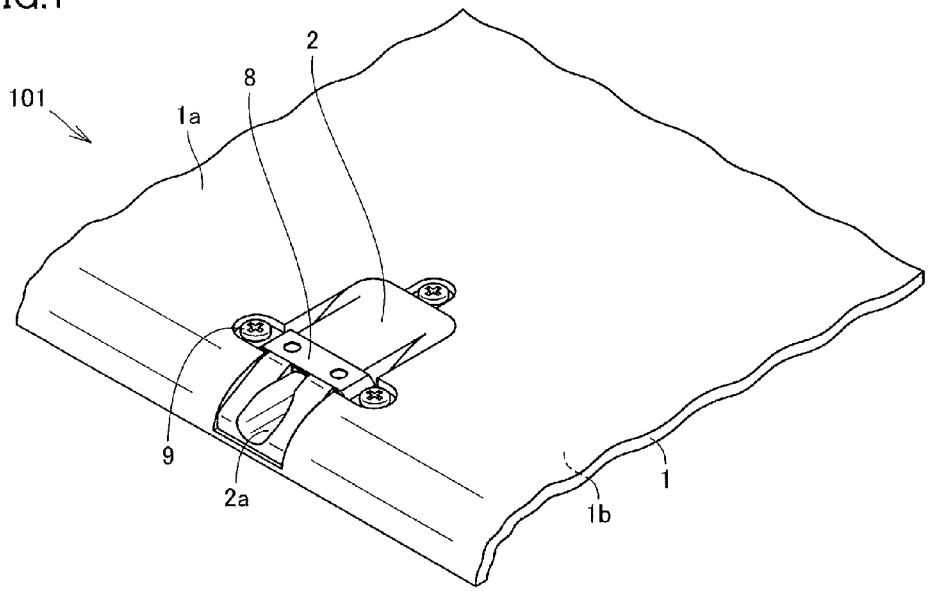
FIG. 1 is a perspective view of an external connection terminal according to a first embodiment based on the present disclosure as seen from the outer surface side.
Figure 2:
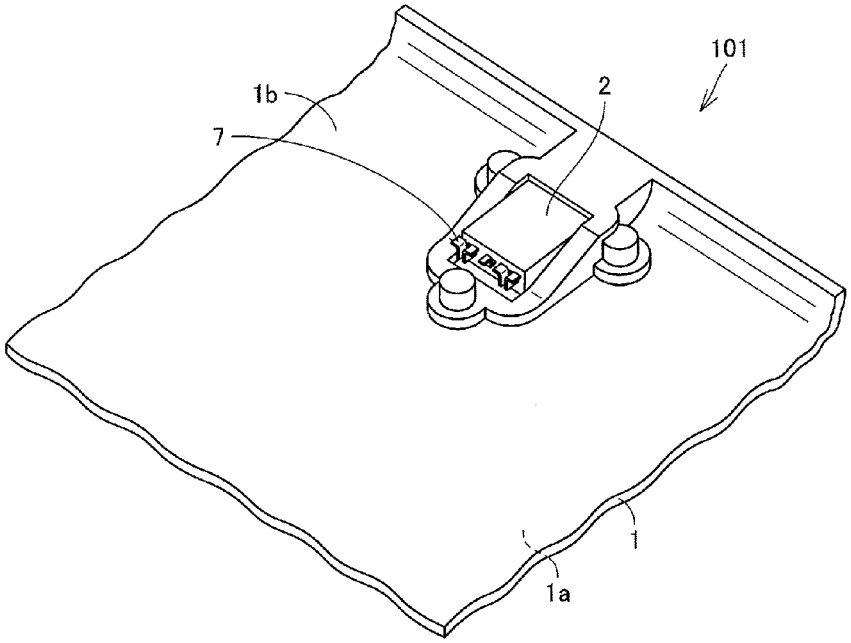
FIG. 2 is a perspective view of the external connection terminal according to the first embodiment based on the present disclosure as seen from the inner surface side.
Figure 3:
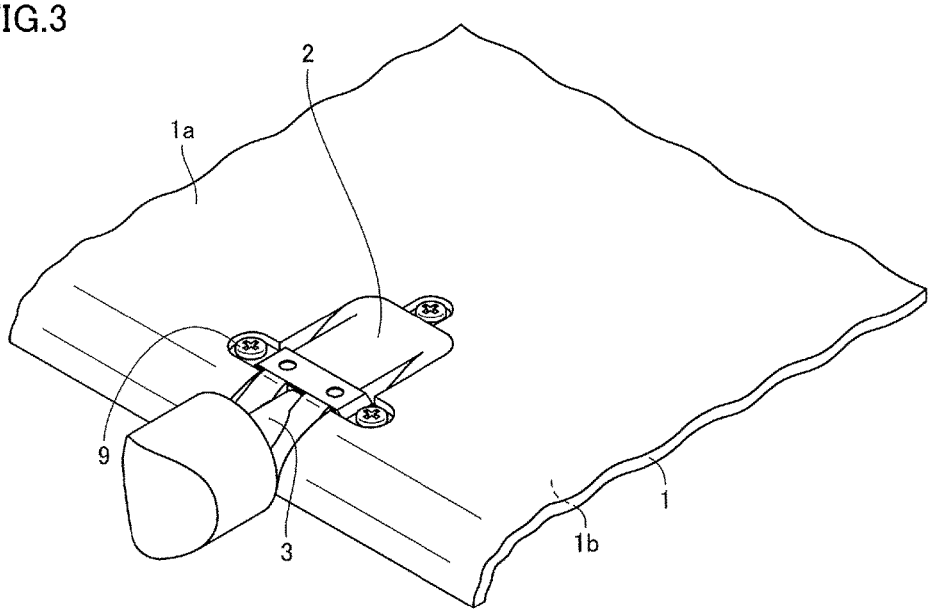
FIG. 3 is a perspective view of the external connection terminal according to the first embodiment based on the present disclosure with a male connector connected thereto.
Figure 4:
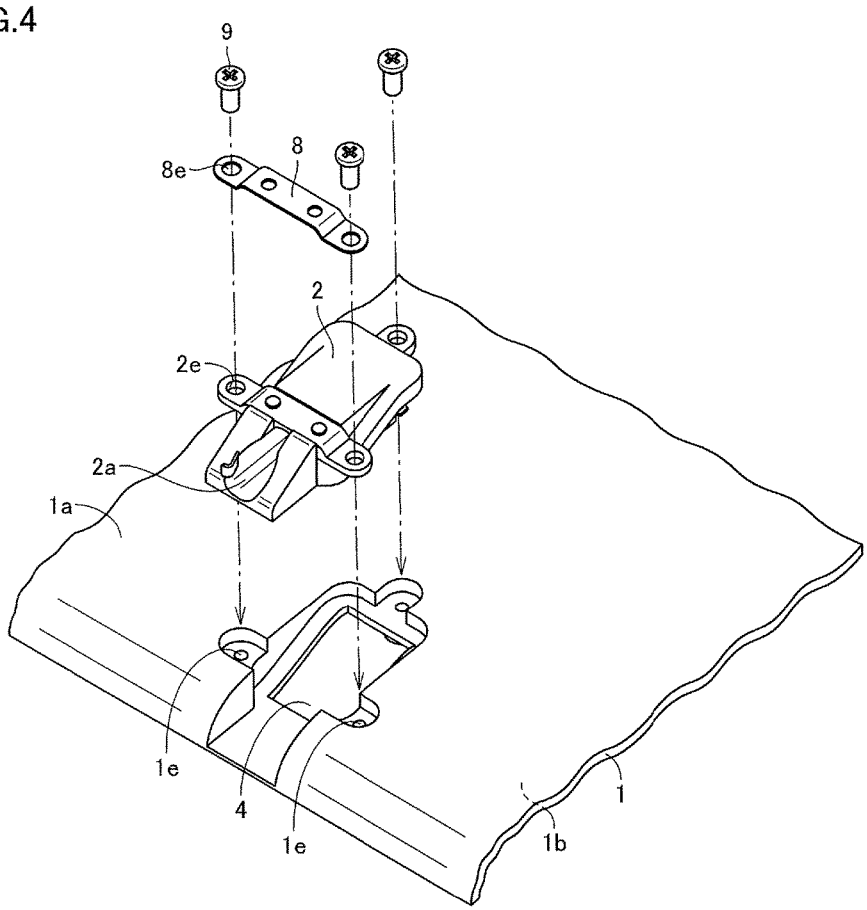
FIG. 4 is an exploded view of the external connection terminal according to the first embodiment based on the present disclosure as seen from the outer surface side.
Figure 5:
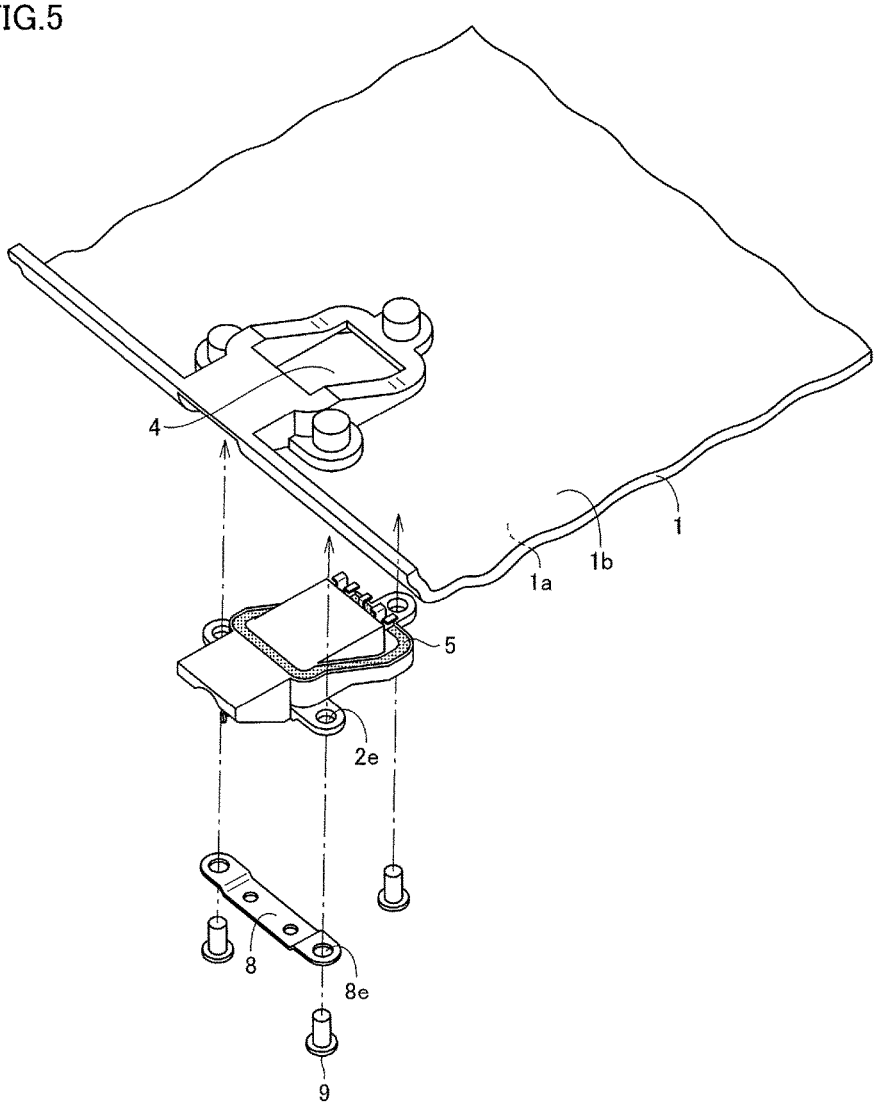
FIG. 5 is an exploded view of the external connection terminal according to the first embodiment based on the present disclosure as seen from the inner surface side.

Referring to FIGS. 1 to 8, an external connection terminal according to a first embodiment based on the present disclosure will be described. FIG. 1 shows a perspective view of an external connection terminal 101 according to the first embodiment. FIG. 2 shows the structure shown in FIG. 1 as seen from the back side. FIG. 3 shows external connection terminal 101 shown in FIG. 1 with a male connector connected thereto. In FIG. 3, a male connector 3 is connected to external connection terminal 101. FIG. 4 is an exploded view of external connection terminal 101. FIG. 5 shows the disassembled state shown in FIG. 4 as seen from the back side.

External connection terminal 101 according to the first embodiment includes: a housing 1 including an outer surface 1*a* and an inner surface 1*b* opposite to outer surface 1*a* and facing a space which should be protected from water, as well as an attachment opening 4 through which outer surface 1*a* and inner surface 1*b* communicate with each other; a female connector main body 2 including a receiving recess 2*a* for receiving at least a part of male connector 3 inserted externally; and an annular seal 5 located so as to surround attachment opening 4.

Figure 6:
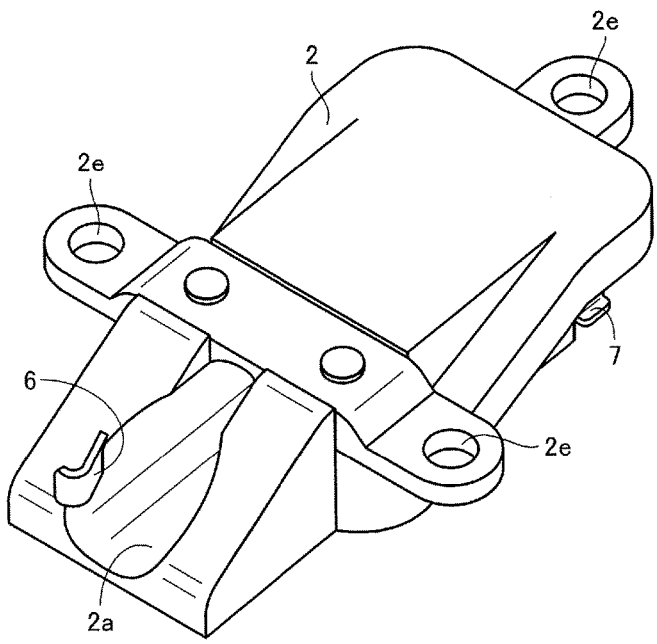
FIG. 6 is a perspective view of a female connector main body and an annular seal included in the external connection terminal according to the first embodiment based on the present disclosure as seen from a first side.
Figure 7:
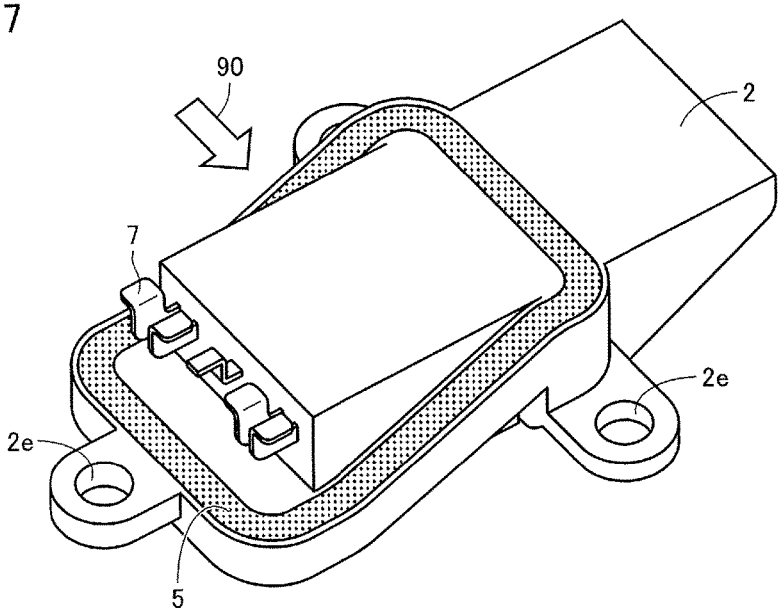
FIG. 7 is a perspective view of the female connector main body and the annular seal included in the external connection terminal according to the first embodiment based on the present disclosure as seen from a second side.

FIG. 6 shows female connector main body 2 and annular seal 5 as taken out. FIG. 7 shows them as seen from the back side. As shown in FIGS. 6 and 7, female connector main body 2 includes a screw hole 2*e*. As shown in FIGS. 4 and 5, female connector main body 2 has been fixed to housing 1 by inserting a screw 9 through screw hole 2*e* of female connector main body 2. As shown in FIGS. 1, 4 and 5, a holder 8 is used at the fixation by screw 9. Holder 8 may be made of metal. Holder 8 may have a plate-like shape. Holder 8 includes a screw hole 8*e*. In the case of using holder 8, screw 9 passes through screw hole 8*e* located in holder 8 and through screw hole 2*e* of female connector main body 2, and then screwed into a screw hole 1*e* in housing 1.

Although FIGS. 1 to 3 show housing 1 as a fragment of a simple shape, this is simplification for ease of description, and actually housing 1 may have a more complicated shape. Housing 1 is usually used as a part or the whole of a housing of an electronic device. Housing 1 has a shape that can contribute to defining some internal space. Housing 1 may enclose the internal space on its own, or may be one of a plurality of components surrounding one internal space.

Figure 8:
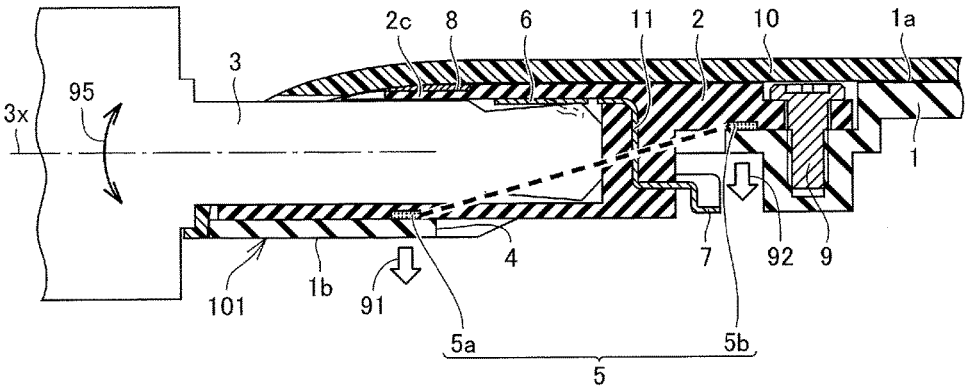
FIG. 8 is a cross sectional view of and around the female connector main body of the external connection terminal according to the first embodiment based on the present disclosure.

FIG. 8 is a cross sectional view of and around female connector main body 2 shown in FIG. 3. In FIG. 8, however, there is an external cover 10 on the outside of external connection terminal 101 unlike FIG. 3. In FIG. 8, connection is achieved by inserting male connector 3 into female connector main body 2. Male connector 3 extends along an axis 3*x*. In this example, male connector 3 is advanced in the direction of axis 3*x* to be fitted within receiving recess 2*a*. However, the advancing direction of male connector 3 is not limited to the same direction as axis 3*x*.

Male connector 3 as a whole is not necessarily fitted completely within receiving recess 2*a*. Receiving recess 2*a* should just be capable of receiving at least a part of male connector 3.

As for annular seal 5, FIG. 8 shows a first portion 5*a* and a second portion 5*b*. Since FIG. 8 is a cross sectional view, they are shown as two separate portions in this way, but first portion 5*a* and second portion 5*b* actually connect annularly to present one annular seal 5.

Female connector main body 2 includes a first conductor exposed portion 6 exposed within receiving recess 2*a*, and a second conductor exposed portion 7 electrically connected to first conductor exposed portion 6 and exposed to the outside of receiving recess 2*a*. Annular seal 5 is located so as to surround second conductor exposed portion 7 and such that the entire circumference can be seen when female connector main body 2 is seen from one direction. In the example described in the first embodiment, the entire circumference of annular seal 5 can be seen from the arrow 90 side in FIG. 7.

Female connector main body 2 is fixed to housing 1 so as to close attachment opening 4 from the outer surface 1*a* side by means of annular seal 5. Annular seal 5 is located between outer surface 1*a* of housing 1 and female connector main body 2. In the example shown in FIG. 8, female connector main body 2 is fixed to housing 1 so as to close attachment opening 4 from the outer surface 1*a* side while pressing annular seal 5 onto the same side. As already described, annular seal 5 surrounds attachment opening 4. When fixing female connector main body 2 to housing 1, annular seal 5 may be pressed onto the same side around the entire circumference of annular seal 5.

At the time point of such assembly at the latest, annular seal 5 is located along the surface of female connector main body 2. The first embodiment describes that annular seal 5 has previously been located on the surface of female connector main body 2, and in this state, female connector main body 2 is attached to housing 1 as shown in FIGS. 5 and 7. This is not a limitation, but annular seal 5 may have previously been located around attachment opening 4 of housing 1, and female connector main body 2 may be attached to such housing 1.

Second conductor exposed portion 7 is exposed toward inner surface 1*b* of housing 1 through attachment opening 4. In the first embodiment, as shown in FIG. 8, female connector main body 2 is fixed to housing 1, while pressing annular seal 5 around the entire circumference in the directions of arrows 91 and 92.

As shown in FIG. 7, one female connector main body 2 may include a plurality of second conductor exposed portions 7. In such a case, a plurality of first conductor exposed portions 6 may be located in one receiving recess 2*a*. There may be the same number of first conductor exposed portions 6 and second conductor exposed portions 7, and they may be electrically connected in parallel to each other. As shown in FIG. 8, first conductor exposed portion 6 and second conductor exposed portion 7 are electrically connected to each other by a wire 11. In this way, wire 11 may have been embedded in resin within female connector main body 2. First conductor exposed portion 6, second conductor exposed portion 7 and wire 11 may be made of metal integrally. Although wire 11 electrically connecting first conductor exposed portion 6 and second conductor exposed portion 7 is entirely shown in FIG. 8, this is a schematic illustration for ease of description. Actually, the whole section of wire 11 is not necessarily seen in this way in one cross sectional view, but may have a complicated shape which is bent in the direction perpendicular to the sheet of drawing, for example.

The reason why the position and shape of first conductor exposed portion 6 shown in FIGS. 4 and 6 differ from those of first conductor exposed portion 6 shown in FIG. 8 is because plurality of first conductor exposed portions 6 are located in receiving recess 2*a* and different first conductor exposed portions 6 among plurality of first conductor exposed portions 6 are seen.

In the first embodiment, since female connector main body 2 is fixed to housing 1 so as to close attachment opening 4 from the outer surface 1*a* side while pressing annular seal 5 around the entire circumference onto the same side, the attachment of female connector main body 2 is facilitated, and the fixation can be achieved by means of screw 9, as described above. Although the structure fixed by screw 9 is shown here as an example, the fixing means is not limited to screw 9, but the fixation may be achieved by other means.

By locating annular seal 5 between female connector main body 2 and housing 1, circulation of water or the like between the outside and the inside of annular seal 5 is less likely to occur. As a result, of the whole surfaces of female connector main body 2, an area on the inner side of annular seal 5 is protected from water. Since an area of the surfaces of female connector main body 2 exposed toward inner surface 1*b* of housing 1 through attachment opening 4 is limited to the area on the inner side of annular seal 5, the inside of housing 1 is protected from water.

Since second conductor exposed portion 7 exposed toward inner surface 1*b* of housing 1 through attachment opening 4 is exposed in the area protected from water in this way, second conductor exposed portion 7 is less likely to become wet with water even if outer surface 1*a* of housing 1 becomes wet with water. Electric connection between second conductor exposed portion 7 and other components can be carried out in an environment without the danger of water immersion.

Since waterproofness is ensured by closing attachment opening 4 while pressing annular seal 5 onto the same side around the entire circumference, it is not necessary to locate any packing so as to surround the female connector main body like external connection terminals based on conventional techniques. Therefore, the end of the housing can be less likely to become a protruding shape.

The external connection terminal according to the first embodiment allows the end of the housing to have a thin shape, while ensuring waterproofness of the external connection terminals.

As described above, external connection terminal 101 may include holder 8 which presses female connector main body 2 toward housing 1. By employing this structure, fixation of female connector main body 2 to housing 1 can be performed reliably. Alternatively, a structure may be employed in which female connector main body 2 is fixed to housing 1 by a screw or other fixing means without using the holder.

In the first embodiment, annular seal 5 is in direct contact with both of female connector main body 2 and housing 1. Along a part or the whole of annular seal 5, any other components may be located between annular seal 5 and female connector main body 2 or between annular seal 5 and housing 1. Female connector main body 2 may press annular seal 5 directly or indirectly against housing 1.

Annular seal 5 may be an annular component, such as a packing. Alternatively, annular seal 5 is not limited to a component initially supplied as a solid like a packing, but an adhesive agent, liquefied resin or the like may be applied annularly. In the case where annular seal 5 is supplied in a state other than the solid state, annular seal 5 may be hardened later or may not be hardened. Annular seal 5 should just be capable of reducing the occurrence of circulation of water or the like between the inside and outside of a ring.

Although the first embodiment mentions annular seal 5 as an example of the seal of the external connection terminal, the seal is not limited to be annular. The external connection terminal may include a seal other than an annular seal. The seal should just surround the attachment opening, and one component may surround the attachment opening as in the example described in the first embodiment, or a combination of two or more components may surround the attachment opening. As an example in which a combination of two or more components constitutes a seal, a structure in which an annular packing is partly notched, and an adhesive agent or the like is applied to the notch can be employed. For example, a structure in which an annular double-faced tape is partly notched, and an adhesive agent or the like is applied to the notch can be employed. Alternatively, the seal may include a combination other than those described herein.

Second Embodiment

Figure 9:
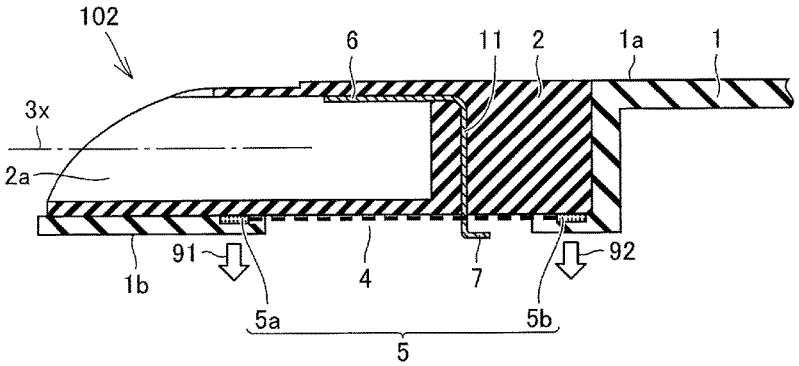
FIG. 9 is a cross sectional view of and around a female connector main body of an external connection terminal according to a second embodiment based on the present disclosure.

Referring to FIG. 9, an external connection terminal according to a second embodiment based on the present disclosure will be described. An external connection terminal 102 according to the second embodiment is similar to external connection terminal 101 described in the first embodiment in basic structure, but differs in the following point.

In external connection terminal 102, second conductor exposed portion 7 is located so as to be exposed from the lower surface of female connector main body 2, and annular seal 5 is located so as to be in contact with the lower surface of female connector main body 2 while surrounding second conductor exposed portion 7. With such a structure, it can also be said that annular seal 5 is located so as to surround second conductor exposed portion 7 and such that the entire circumference of annular seal 5 can be seen when female connector main body 2 is seen from one direction.

Female connector main body 2 is pressed against and fixed to housing 1 as indicated by arrows 91 and 92. With such a structure, it can also be said that annular seal 5 is fixed to housing 1 so as to close attachment opening 4 from the outer surface 1*a* side, while pressing annular seal 5 onto the same side around the entire circumference.

In the second embodiment, effects similar to those of the first embodiment can be acquired.

Third Embodiment

Figure 10:
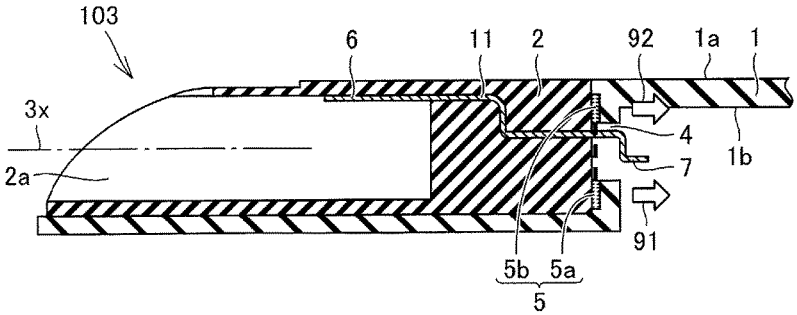
FIG. 10 is a cross sectional view of and around a female connector main body of an external connection terminal according to a third embodiment based on the present disclosure.

Referring to FIG. 10, an external connection terminal according to a third embodiment based on the present disclosure will be described. In an external connection terminal 103 according to the third embodiment is similar to external connection terminal 101 described in the first embodiment in basic structure, but differs in the following point.

Hereinafter, the side which receiving recess 2*a* of female connector main body 2 faces shall be the front side, and the opposite side shall be the back side for ease of description. The left side in FIG. 10 is the front side, and the right side is the back side. In FIG. 10, a right end surface of female connector main body 2 serves as a back end surface.

In external connection terminal 103, second conductor exposed portion 7 is located so as to be exposed from the back end surface of female connector main body 2, and annular seal 5 is located so as to be in contact with the back end surface of female connector main body 2 while surrounding second conductor exposed portion 7. With such a structure, it can also be said that annular seal 5 is located so as to surround second conductor exposed portion 7 and such that the entire circumference of annular seal 5 can be seen when female connector main body 2 is seen from one direction.

Female connector main body 2 is pressed against and fixed to housing 1 as indicated by arrows 91 and 92. With such a structure, it can also be said that annular seal 5 is fixed to housing 1 so as to close attachment Opening 4 from the outer surface 1*a* side, while pressing annular seal 5 onto the same side around the entire circumference.

In the third embodiment, effects similar to those of the first embodiment can be acquired.

Although the second and third embodiments show possible examples, a structure as described in the first embodiment may be actually employed. Annular seal 5 may be located obliquely with respect to axis 3*x* of male connector 3, as shown in FIG. 8. Such a structure increases design flexibility in the arrangement of second conductor exposed portion 7 and the direction in which female connector main body 2 is attached to housing 1. It is also possible to attach female connector main body 2 to housing 1 in a direction different from axis 3*x* of male connector 3, for example, in a direction perpendicular to axis 3*x* as indicated by arrows 91 and 92 while exposing second conductor exposed portion 7 in the extending direction of axis 3*x* of male connector 3, as shown in FIG. 8.

In the case where the axial direction of male connector 3 is parallel to the main surface of housing 1, electric connection within housing 1 can be performed without increasing the dimension of housing 1 in the thickness direction (the vertical direction in FIG. 8), if second conductor exposed portion 7 is exposed in the extending direction of the axis of male connector 3. Attachment of female connector main body 2 to housing 1 can be performed in the thickness direction of housing 1, and therefore, the attachment can be performed reliably using a large surface.

Besides the structure of the second embodiment, the structures as described in the first and third embodiments may be employed. Second conductor exposed portion 7 may be located at the surface of female connector main body 2 opposite to receiving recess 2*a*. The surface of female connector main body 2 opposite to receiving recess 2*a* means the right end surface in FIG. 8 or 10. By employing this structure, electric connection within housing 1 can be performed without increasing the dimension of housing 1 in the thickness direction (the vertical direction in FIG. 8).

As shown in FIG. 8, female connector main body 2 may include a thin portion 2*c* which is adjacent to receiving recess 2*a* and is thinner than the remaining portion, and holder 8 may be located to overlap thin portion 2*c*. When female connector main body 2 includes thin portion 2*c* in this way, slim appearance can be achieved. Although the strength may become insufficient merely by locating thin portion 2*c* at a position adjacent to receiving recess 2*a*, holder 8 located to overlap thin portion 2*c* reinforces thin portion 2*c*, so that breakage of thin portion 2*c* can be less likely to occur. Since holder 8, which is a component different from female connector main body 2, is utilized for reinforcement, a material of high strength can be employed for holder 8. Since holder 8 can be made of metal, for example, while the material of female connector main body 2 is resin, for example, reinforcement can be performed efficiently. With such reinforcement, the strength on the female connector main body 2 side against wrenching caused by male connector 3 can be ensured sufficiently. The "wrenching" indicates, for example, that a force in directions indicated by an arrow 95 is exerted in male connector 3 connected as shown in FIG. 8.

Fourth Embodiment

Figure 11:
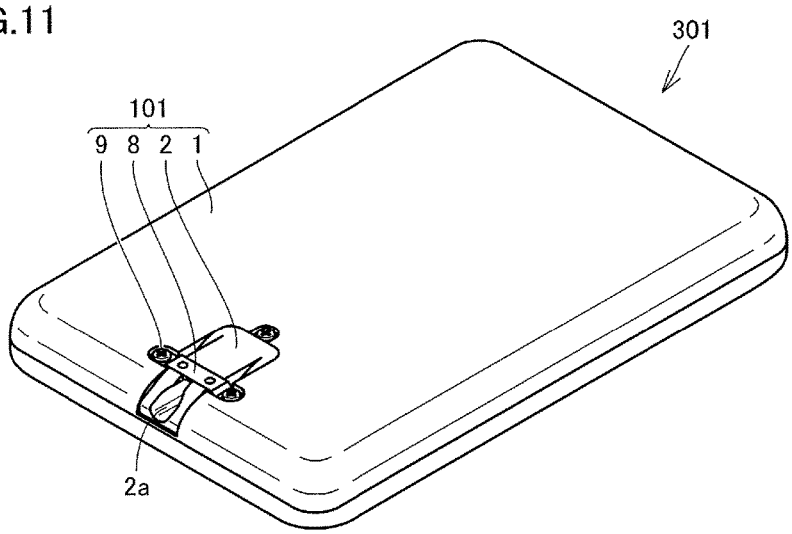
FIG. 11 is a perspective view of a first example of an electronic device according to a fourth embodiment based on the present disclosure where the back side can be seen.

Referring to FIGS. 11 to 14, an electronic device according to a fourth embodiment based on the present disclosure will be described. The electronic device according to the fourth embodiment includes the external connection terminal described in any of the above embodiments. An electronic device 301 shown in FIG. 11, for example, includes external connection terminal 101 described in the first embodiment. In FIG. 11, the back side of electronic device 301 can be seen.

Figure 12:
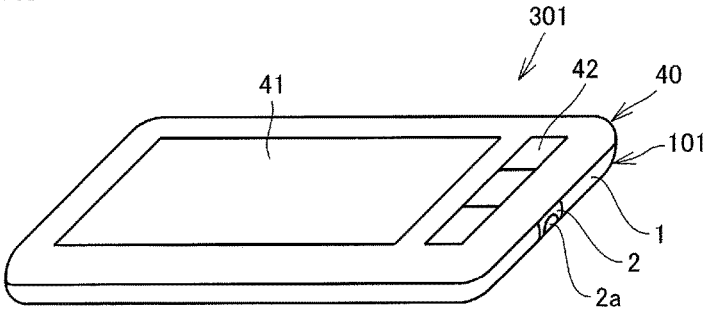
FIG. 12 is a perspective view of the first example of the electronic device according to the fourth embodiment based on the present disclosure where the front side can be seen.

FIG. 12 shows electronic device 301 shown in FIG. 11 as turned over. In FIG. 12, the front side of electronic device 301 can be seen. As shown in FIG. 12, electronic device 301 according to the fourth embodiment includes an assembled structure 40 as a front-side housing component where a screen 41 is located. The front-side housing component implemented by assembled structure 40 and external connection terminal 101 serving as the rear-side housing component are combined together to constitute the most part of the contour of electronic device 301.

Although assembled structure 40 and external connection terminal 101 are exposed on the outermost side in FIG. 12, actually, an exterior case (not shown) may be further located on the outside.

In the example shown in FIG. 12, buttons 42 are located in assembled structure 40. Buttons 42 shown here are a mere example, and their position, shape, number, and the like are not limited as such.

Screen 41 includes a display panel, for example. The display panel may be a liquid crystal display panel, or may be an organic electroluminescence panel, for example. The display panel may be a panel having a display function of a type other than that illustrated herein. The display panel is controlled by a controller not shown to display various types of information, such as characters, symbols, graphics, and the like. Screen 41 may include a cover panel located on the outside of the display panel. When the cover panel is located, information displayed on the display panel is visible to a user through the cover panel.

Screen 41 includes a touch panel, for example. The touch panel is a projective capacitive sheet-like touch panel, for example. The touch panel detects contact of an object with screen 41, and outputs a detection signal in accordance with the detection result. The controller not shown specifies the details of a manipulation performed on screen 41 based on the detection signal output from the touch panel, and executes an operation in accordance with the details of the manipulation.

In screen 41, the display panel and the touch panel may be prepared as separate panels, and may be located to overlap each other, but a single panel with a touch detection function having both the functions may be used. Also when the display panel with a touch detection function, a cover panel may be located to overlap the outside of the display panel.

Screen 41 is plate-like, for example, and has a shape having a certain longitudinal direction when viewed in plan view. In the example shown in FIG. 12, screen 41 is rectangular as a whole. Screen 41 may have a planar shape as a whole, or may have a curved shape at least partly.

Although buttons 42 are located at the position different from screen 41 in the example shown in FIG. 12, buttons 42 may be located within screen 41.

In electronic device 301 shown in FIGS. 11 and 12, female connector main body 2 of external connection terminal 101 and the like are exposed as they are. Electronic device 301 with a certain external cover attached to the outside of electronic device 301 may be regarded as an electronic device as a whole. A device such as an electronic device 302 shown in FIG. 13, for example, may be employed. Electronic device 302 includes external cover 10. Electronic device 302 includes external connection terminal 101 on the inner side of external cover 10. External cover 10 included in electronic device 302 includes an opening 10*a* for external connection, and receiving recess 2*a* is exposed through opening 10*a* of external cover 10. In electronic device 302, male connector 3 can be connected to and removed from receiving recess 2*a* through opening 10*a* with external cover 10 being attached.

Figure 13:
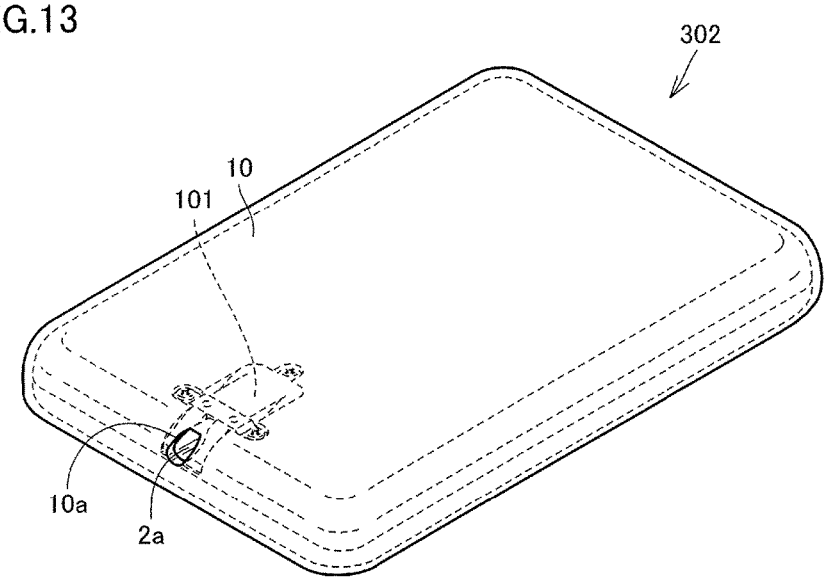
FIG. 13 is a perspective view of a second example of the electronic device according to the fourth embodiment based on the present disclosure where the back side can be seen.
Figure 14:
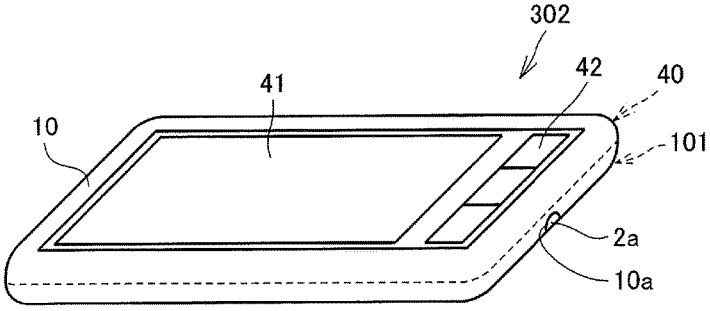
FIG. 14 is a perspective view of the second example of the electronic device according to the fourth embodiment based on the present disclosure where the front side can be seen.

FIG. 14 shows electronic device 302 shown in FIG. 13 as turned over. In FIG. 14, the front side of electronic device 302 can be seen. Screen 41 and button 42 are exposed through an opening located on the front side of external cover 10. The shape of external cover 10 shown here is a mere example, and is not limited to this. The shape of the opening on the front side of external cover 10 is designed as appropriate depending on the position, shape, number, and the like of screen 41 and button 42. The contour of external cover 10 may also be changed by applying a design thereto as appropriate.

Since the electronic device according to the fourth embodiment includes the external connection terminal described in any of the above embodiments, an electronic device with the end of the housing having a thin shape while ensuring waterproofness of the external connection terminal can be obtained.

Although the fourth embodiment is described as an electronic device, the electronic device may be, for example, a mobile phone, a personal digital assistant, a tablet terminal, a personal computer, a game machine, a television set, a portable music player, a CD (Compact Disc) player, a DVD (Digital Versatile Disc) player, an electronic dictionary, a digital book reader, a digital camera, a video camera, a radio receiver, a car navigation system, or the like. A smartphone is included in the concept of a mobile phone.

Although the present disclosure has been described and illustrated in detail, it is clearly understood that the same is by way of illustration and example only and is not to be taken by way of limitation, the scope of the present disclosure being interpreted by the terms of the appended claims.

The invention claimed is:

1. An electronic device comprising:

a housing including an outer surface and an inner surface, the housing including an opening through which the outer surface and the inner surface communicate with each other;

a female connector including a receiver configured to receive at least a part of a male connector configured to be inserted therein, the female connector including a conducting portion located to face the inner surface of the housing and electrically connectable to the male connector through the opening; and a seal located around the opening and wherein at least a portion of the seal lies in a plane that is oblique with respect to a direction in which the male connector is inserted into the receiver.

2. The electronic device according to claim 1, wherein the conducting portion is located at a position opposite to the position where the receiver of the female connector is located.

3. The electronic device according to claim 2, further comprising a holder configured to press the female connector against the housing.

4. The electronic device according to claim 3, wherein the female connector includes a thin portion which is adjacent to the receiver and which is thinner than a remaining portion, and the holder is located so as to overlap the thin portion.

* * * * *